United States Patent [19]

Park et al.

[11] Patent Number: 4,638,872

[45] Date of Patent: Jan. 27, 1987

[54] CORE MONITORING DEVICE

[75] Inventors: Arthur Park, Odessa; Bob T. Wilson, Midland, both of Tex.

[73] Assignee: Diamond Oil Well Drilling Company, Midland, Tex.

[21] Appl. No.: 718,543

[22] Filed: Apr. 1, 1985

[51] Int. Cl.[4] ..... E21B 25/00

[52] U.S. Cl. ..... 175/46; 175/58; 175/244

[58] Field of Search ..... 175/20, 44, 46, 58, 175/244

[56] References Cited

U.S. PATENT DOCUMENTS

| | | | |
|---|---|---|---|
| 455,037 | 6/1891 | Gardner . | |
| 664,902 | 1/1901 | Scott et al. . | |
| 1,283,542 | 11/1918 | Murphy et al. . | |
| 2,046,798 | 7/1936 | Thrift . | |
| 2,096,798 | 10/1937 | Mizell . | |
| 2,138,006 | 11/1938 | Howard . | |
| 2,342,253 | 2/1944 | Cooley . | |
| 2,555,275 | 5/1951 | Millison . | |
| 3,344,872 | 10/1967 | Bergan | 175/46 |
| 3,605,920 | 9/1971 | Woodward | 175/46 |
| 3,812,922 | 5/1974 | Stechler | 175/6 |
| 3,901,075 | 8/1975 | Hampton et al. . | |
| 4,479,557 | 10/1984 | Park et al. | 175/46 |
| 4,499,955 | 2/1985 | Campbell et al. | 175/46 |
| 4,499,956 | 2/1985 | Campbell et al. | 175/46 |
| 4,502,553 | 3/1985 | Park et al. | 175/46 |

*Primary Examiner*—Stephen J. Novosad
*Assistant Examiner*—Bruce M. Kisliuk
*Attorney, Agent, or Firm*—Jerry W. Mills; Gregory M. Howison

[57] ABSTRACT

A well coring apparatus is provided with the capability for monitoring the length of the core in the inner barrel (32) of a core barrel (16) and the rate at which the core enters the inner barrel (32). The device includes a Sonic Core Monitor (78) which is disposed in the upper end of the inner barrel (32) and a piston (68) which is disposed in the lower end thereof. The Sonic Core Monitor (78) generates an ultrasonic pulse that is transmitted down to the surface of the piston (68) and reflected back up to the Sonic Core Monitor (78). The time between the transmitted and received pulse is then measured and distance determined therefrom. Both length of core and rate of core entry into the inner barrel (32) can then be determined. If the core is proceeding at too slow a rate, a valve (50) can be opened to allow drilling fluid to bypass the core barrel (16). This provides the surface operator with an indication that a jam has occurred.

18 Claims, 8 Drawing Figures

CORE MONITORING DEVICE

TECHNICAL FIELD OF THE INVENTION

The present invention pertains in general to apparatus for well coring and, more particularly, to well coring apparatus utilizing a measurement device for measuring the length of the core in the inner barrel during the coring operation.

CROSS REFERENCE RELATED APPLICATION

This application is related to Ser. No. 661,893, filed Oct. 17, 1984, now U.S. Pat. No. 4,598,777, which is a continuation-in-part of U.S. patent application Ser. No. 4,479,557.

BACKGROUND OF THE INVENTION

To analyze the amount of oil that is contained in a particular soil and at a particular depth in the proximity of a substerranean well requires extraction of a sample of the well material. An analysis of this material yields the percent of fluid and/or gas contained therein which information is utilized to determine the type of fluid, such as oil, contained therein and the pressure thereof. However, in view of the cost of extracting the core, it is important to extract the core in as intact a condition as possible. Methods for coring a well are discussed in general in U.S. Pat. No. 4,312,414 and 4,479,557, issued to Park et al and assigned to Diamond Oil Well Drilling Co.

One factor that can significantly increase the cost per foot of extracted core is jamming of the core during the coring process. Once jammed, the entry of the core into the inner barrel of the coring device is prohibited and the coring device must then be extracted from the bore hole and the jam cleared. However, the presence of a jammed core is difficult to ascertain since the coring process is dependent upon depth measurements at the surface. Therefore, a coring device may have a core jammed therein and the coring procedure continued without knowledge of this jam. This can result in additional damage to the coring device.

One method for preventing this jamming is to monitor the length of the core as is moves up the inner core barrel and compare this with the depth of the drill. A number of devices have been disclosed in U.S. Pat. Nos. 2,555,272, issued to Millison, 3,344,872, issued to Bergan, 3,605,920, issued to Woodward and 2,342,253, issued to Cooley. For example, the Millison device utilizes a clockwork instrument disposed in contact with a plug that seals the inner barrel. The clockwork instrument is in contact with the upper end of the inner barrel through a retracting wire. As the instrument is urged upward by the core entering the inner barrel, the retracting mechanism operates numerous gears to record core length information. As a further example, Bergan discloses a device having a chain disposed in the inner barrel from a weight measuring device. As the core moves upward into the inner barrel, the links of the chain are slowly removed, thus reducing the weight of the chain. This weight is measured and data transmitted through a transducer to the surface. Although these prior devices measure the length of the core in the barrel during the coring operation, they do not compensate for the environment at the bottom of the bore hole. During drilling, this environment is subject to high G-forces and pressures. A gear mechanism disposed in the inner barrel with a retracting wire would be such a delicate mechanism that reliability would be questionable.

In view of the above disadvantages, there exists a need for a device for monitoring the movement of the core into the inner barrel in addition to transmitting this information to the surface.

SUMMARY OF THE INVENTION

The present invention disclosed and claimed herein comprises a well coring apparatus for extracting a core and holding it in a container. A measurement device is disposed in the upper end of the container for generating ultrasonic pulses directed downward at the core and receiving the reflected energy of this generated pulse from the core. The time interval for the pulse to travel down and be reflected from the core is measured and distance calculated therefrom. This distance is stored and successive measurements made. The difference between successive distance measurements is calculated and compared with the predetermined value. If the distance measurement is less than the predetermined value, a fault signal is generated. This fault signal is transmitted to the surface to indicate the presence of a jam or a default of some type.

In another embodiment of the present invention, the fault signal operates a pressure valve in the coring device that relieves the pressure therein. This reduction in pressure is measured at the surface and appropriate action is taken to prevent damage to the coring device.

BRIEF DESCRIPTION OF THE DRAWINGS

For a more complete understanding of the present invention and the advantages thereof, reference is now made in the following description taken in conjunction with the accompanying Drawings in which.

DETAILED DESCRIPTION OF THE INVENTION

Figure 1:
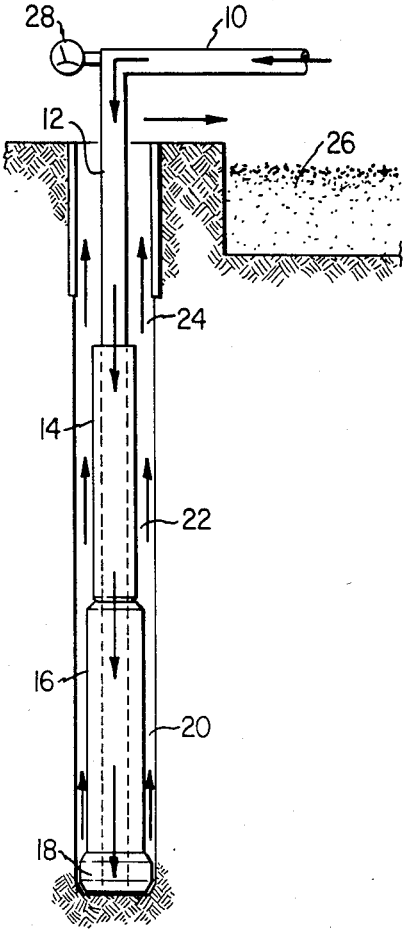
FIG. 1 illustrates a cross sectional view of the coring device disposed in the bore hole.

Referring now to FIG. 1, there is illustrated a cross sectional diagram of the coring device of the present invention inserted in a bore hole. The coring device is comprised of a surface pipe 10 which is connected to an inside drill pipe 12 which is disposed in the upper end of the bore hole and extend downward into the bottom of the bore hole. At the bottom of the bore hole, the inside drill pipe 12 is connected to an inside collar 14 which has a diameter that is larger than the inside drill pipe 12. The inside collar 14 is connected at the lower end thereof to a core barrel 16, which has a coring bit 18 disposed on the end thereof and proximate the bottom of the bore hole.

In the drilling operation, mud or similar drilling fluid is pumped down through the pipe sections 10, 12 and the collar 14 to the core barrel 16 to exit at the coring bit 18. This fluid then passes around the coring bit 18 and back up through the bore hole about the apparatus. The annulus formed around the apparatus varies as a function of depth and as a function of the diameter of the apparatus. Proximate the core barrel 16 is an annulus 20, proximate the inside collar 14 is an annulus 22 and proximate the inside drill pipe 12 is an annulus 24. As fluid is pumped around the bit 18, the pressure varies as the fluid passes from annulus 20 to the annulus 22 to the annulus 24, depending upon the restriction and the weight of the driling fluid. The drilling fluid is delivered to a mud pit 26 on the surface which is at atmospheric pressure. The pressure in the stand pipe is measured with a stand pipe pressure gauge 28 disposed at the surface of the bore hole. As will be described hereinbelow, This pressure is monitored to determine certain operating properties of the drilling operation. This pressure, in some applications, can be varied with apparatus disposed at the bottom of the bore hole such that information gathering devices disposed at the bottom of the bore hole can transmit data via pressure variations. This is disclosed in U.S. Pat. Nos. 4,078,628, issued to Westlake et al and 3,964,556, issued to Gearhart et al and assigned to Gearhart-Owen Industries Inc., both of which are incorporated herein by reference.

Figure 2:
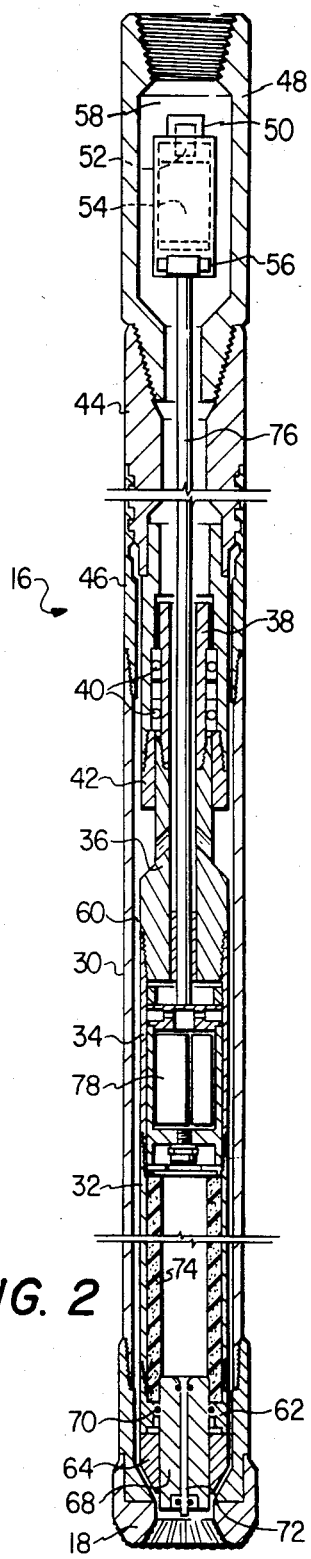
FIG. 2 illustrates a cross sectional view of the coring device.

Referring now to FIG. 2, there is illustrated a cross sectional view of the core barrel 16. The core barrel 16 is comprised of an outer barrel 30 which has the core bit 18 attached to the end thereto. The outer barrel 30 rotates with the drill string with an inner barrel 32 disposed internal thereto and rotatable with respect thereto. The inner barrel 32 is threadedly engaged with an adapter sub 34 for enclosing the monitoring apparatus, the adapter sub 34 being threadedly engaged with a flow tube 36. The flow tube 36 is threadedly engaged with a retainer 38 which has bearings 40 disposed thereabout. The bearings are supported by a bearing stop 42 and are operable to allow the flow tube to rotate with respect to the outer barrel 30. The outer barrel 30 is threadedly engaged to a safety joint box 44 through an adapter 46. The safety joint box 44 is in turn threadedly engaged with a valve adapter housing 48. The valve adapter housing 48 is threadedly engaged with the remaining portions of the drill string.

The valve adapter housing 48 includes a valve 50 with control circuitry 52 and battery supply 54 associated therewith. A switch 56 is disposed in the lower end of the interior of the valve adapter housing 48 for controlling the operation of the valve 50. The valve 50 is operable to relieve pressure within the drill string by bypassing all or a portion of the drilling fluid to the exterior of the drill string, as will be described hereinbelow.

The drilling fluid is passed down the center of the drill string through a hollow central portion 58. Drilling fluid passes about the valve 50 and the associated control circuitry 52 and battery 54. The drilling fluid then passes down through the flow tube 36 and through an annulus 60 between the outer barrel 30 and the inner barrel 32. The inner barrel 32 is threadedly engaged at the lower end thereof to an inner barrel sub 62. The inner barrel sub 62 is threadedly engaged on the lower end thereof to a core catcher sub 64 for receiving the core during drilling thereof.

A piston 68 is disposed in the lower end of the inner barrel and protruding slightly outward from the core catcher sub 64. An O-ring 70 is disposed around the piston 68 and seated in the inner barrel sub at the lower end thereof. The piston 68 has a valve 72 disposed at the center thereof that is operable to release pressure in the inner barrel 32 when the valve contacts the top of the core. The pressure is relieved through the valve 72 and through the bottom of the piston 68. In operation, the piston provides a seal for the inner barrel 32 until the core is contacted. At that point, pressure within the inner barrel 32 is relieved and the piston 68 urged upward by the core into the inner barrel 32. The operation of this piston is fully described in U.S. patent application Ser. No. 661,893.

A cylindrical sponge 74 is disposed on the interior walls of the inner barrel 32 and is slideably disposed therein. In the preferred embodiment, the cylindrical sponge 74 is attached to a cylindrical liner on the exterior thereof, the cylindrical liner operable to slide against the interior walls of the inner barrel 34. In the preferred embodiment, the liner is fabricated from aluminum and the sponge 74 is fabricated from polyurethane foam. The foam is comprised of a plurality of cells, some of which are open and some of which are closed. The use and construction of this foam is fully disclosed in U.S. Pat. No. 4,312,414, issued to the present applicant.

The sponge 74 is dimensioned to define a bore through the middle thereof for receiving the core. The interior of the inner barrel is pressurized with a liquid to prevent contaminants from coming into contact with the exposed surface of the sponge 74 and being absorbed into the interstices thereof. As described above, the pressure is equilibrated when the valve 72 in the piston 68 is opened upon contact with the core. A Sonic Core Monitor (SCM) 78 is disposed in the adapter 34 and is in sonic communication with the interior of the inner barrel 32. The SCM 78 is operable to transmit ultrasonic pulses through the pressurized liquid in the inner barrel 32 and receive reflections from the upper surface of the piston 68. In operation, it is only important that the piston 68, or any device that precedes the core up the barrel, has a reflective surface.

The SCM device 78 is connected to the switch 56 through an extension rod 76 to activate the valve 50 when predetermined conditions are met. When these predetermined conditions are met, the valve 50 is activated and fluid is bypassed from the flow going into the core barrel 16. As will be described hereinbelow, the SCM device 78 makes a number of measurements and correlates these measurements to distinguish between spurious noise and other extraneous sources of noise that are in the bandwith of the SCM device 78. The SCM device 78 is selfcontained such that no interface is required with the surface. If movement is not detected over a predetermined period of time, the valve 50 is opened to cause a sudden pressure drop and indicate to the surface that the core is not proceeding upward into the inner barrel 32.

Figure 3:
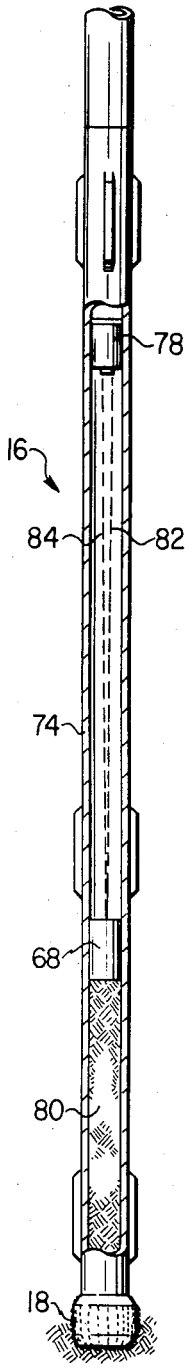
FIG. 3 illustrates a cross sectional view of the lower end of the coring device with a core partially disposed therein.

Referring now to FIG. 3, there is illustrated a cross sectional diagram of the lower end of the core barrel 16 showing a core 80 extending upward into the inner barrel 32 and preceded by the piston 68. The SCM device 78 outputs a transmitted pulse at a predetermined frequency, as noted by the dotted lines 82. In the preferred embodiment, this frequency is in the ultrasonic range. The reflection from the surface of the piston 68 is noted by the dotted lines 84. As will be described hereinbelow, the SCM device 78 determines the length of time required for the pulse to travel to the surface of the piston 68 and back to the SCM device 78. The distance can then be calculated since the transmission speed for the given medium is known.

The use of ultrasonic waves for determining distance has a number of disadvantages. Some of the disadvantages are that spurious signals can resemble a reflected pulse and cause errors in the measurement. The spurious noises can result from vibrations in the core barrel 16 or in reflections from particles in the medium between the SCM 78 and the piston 68. In order to reduce error, the measurement is made a predetermined number of times and the various measurements compared with each other to determine if a correlation exists. If so, a valid measurement exists. However, if the measurements vary, this indicates that they are due to other sources than the mere reflection off the surface of the piston 68.

The sponge 74, in addition to absorbing the subterranean fluids from the core, also acts as a sound absorber on the sides of the inner barrel 32. Since the structure of the foam utilizes a semi-opened celled structure, the attenuation of waves impinging upon the surface thereof is high. This significantly reduces internal reflections, thus improving the measurement of distance between the SCM 78 and the piston 68.

The information regarding distance versus time as the core 80 proceeds upward into the inner barrel 32 is stored in the SCM 78 for later retrieval therefrom. Therefore, the SCM 78 provides two functions. First it measures and records distance versus time for the entire coring process and stores this information at the bottom of the bore hole. This information can at a later time be analyzed and compared with drilling records on the surface. Secondly, the SCM 78 determines if the core is entering the inner barrel 32 at a sufficient rate to indicate proper coring. If the coring procedure is determined to be at a rate slower than a predetermined rate, the SCM 78 activates a valve to reduce pressure, this reduction in pressure is visible at the surface. The operator can then terminate the coring procedure and withdraw the core barrel 16 to determine what the cause of the coring fault is. With early detection of the coring fault, further damage can be prevented, thus reducing the cost per foot of core.

Figure 4:
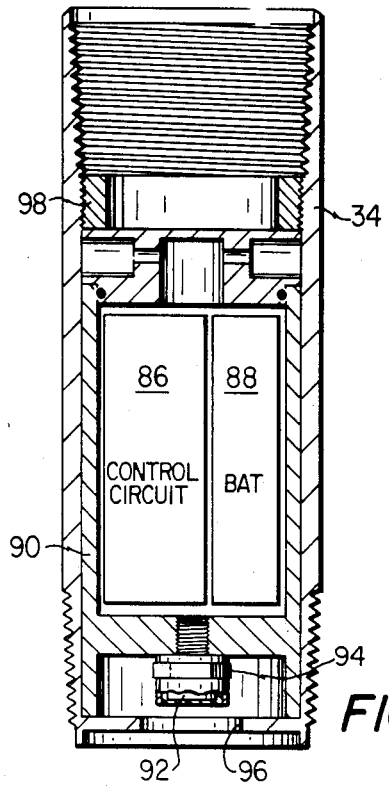
FIG. 4 illustrates a cross sectional view of the housing for containing the transducer and associated circuitry.

Referring now to FIG. 4, there is illustrated a cross sectional diagram of the adapter sub 34 for housing the SCM 78. The SCM 78 is comprised of a control circuit 86 and a battery unit 88. The control circuit 86 and battery unit 88 are housed in a SCM housing 90 which is a cylindrical unit for slideably fitting within the adapter sub 34. In the lower end of the SCM housing 90, a piezoelectric transducer 92 is mounted in a transducer housing 94. A layer of material 96 is disposed at the bottom of the adapter sub 34 and is operable to protect the transducer 92 from the interior of the inner barrel 32. The layer 96 can be fabricated from any type of material that will seal the inner barrel 32 and is transparent to ultrasonic waves, such as a plate fabricated from glass or quartz.

The SCM housing 90 is inserted into the adapter sub 34 and a lock ring 98 disposed over the top thereof and threadedly engaged with the innersides of the adapter sub 34. The SCM housing 90 is designed such that it will survive the G-forces experienced at the bottom of the bore hole.

Figure 5:
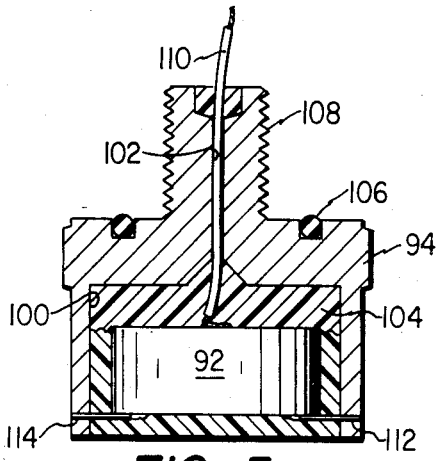
FIG. 5 illustrates a cross sectional view of the transducer mounting.

Referring now to FIG. 5, there is illustrated a cross sectional diagram of the transducer 92 and transducer housing 94. The housing 94 has a cavity 100 formed in the end thereof with a conduit 102 extending from the bottom of the cavity 100 to the rear portion along the axis of the housing 94. The piezoelectric transducer 92 is fabricated from a lead titanate zirconate piezoelectric device which is manufactured by EDO Corporation, Model No. EC-64. The dimensions of the transducer are approximately one centimeter thick with a 2.5 centimeter diameter. The transducer 92 is mounted on the bottom of the cavity 100 with a flexible epoxy 104 of the type 2216 manufactured by 3M Corporation. The epoxy is only adhered to one surface of the piezo transducer 92 such that the sides thereof are disposed from the sides of the cavity 100. The remainder of the cavity and the outer surface of piezo transducer 92 are covered by RTV which is a vulcanized compound manufactured by Dow Corning Corporation.

A groove 106 is disposed on the backside of the housing 94 for receiving an O-ring. The groove is disposed on an annular surface perpendicular to the central axis of the housing 94 for mating with the bottom of the SCM housing 90. A neck portion 108 is operable to insert through an orifice in the bottom of the SCM housing 90 for communication with the control circuit 86.

A wire 110 is disposed through the conduit 102 for connection to the backside of the transducer 92 and to the control circuit 86. The opposite side of the transducer 92 is connected through wires 112 and 114 to the peripheral edge of the transducer housing 94. This allows one side of the transducer 92 to be connected to the housing, which functions as one polarity of the power supply potential that drives the control circuit 86.

Figure 6:
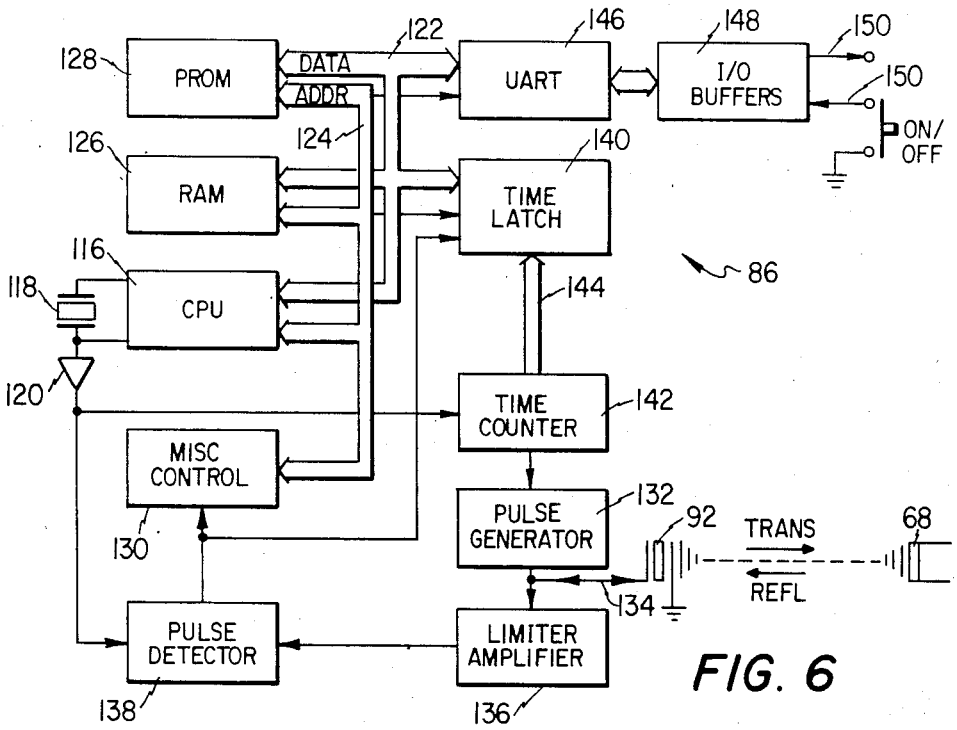
FIG. 6 illustrates a schematic block diagram of the control electronics for the transducer.

Referring now to FIG. 6, there is illustrated a schematic block diagram of the control circuit 86 in the SCM 78. A Central Processing Unit (CPU) 116 is provided that utilizes a microprocessor of the type CDP1802 manufactured by RCA Corporation. A quartz crystal 118 is provided and connected to the CPU 116 to provide a time base therefor. This time base is tapped off from the quartz crystal 118 through a buffer circuit 120 for the rest of the circuit. The CPU 116 is connected through to data out ports thereof to a data bus 122 and from the address ports thereof to an address bus 124. The CPU 116 is operable to control the transducer 92 and the operation thereof.

A Random Access Memory (RAM) 126 is connected to the data and address buses 122 and 124 and is operable to store data therein for later retrieval. In addition, the RAM 126 can store programmed instructions for use by the CPU 116. A Programmable Read Only Memory (PROM) 128 is also connected to the data bus 122 and address bus 124 and is operable to store predetermined programmed instructions for use by the CPU 116. The address bus 124 is also connected to a miscellaneous control circuit 130 providing various instructions, as will be described hereinbelow.

A pulse generator 132 is provided which is controlled by the CPU 116 to output a pulse having a voltage level of around 70 to 80 volts for input to the transducer 92 on a line 134. In the pulse generation mode, the pulse is transmitted from the transducer 92 over a very short duration of time. The line 134 is also connected to the input of a limiter/amplifier 136 for sensing the reflected wave received by the transducer 92. The output of the limiter/amplifier 136 is input to a pulse detector 138, which also receives the clock signal output by the buffer 120. The pulse detector 138 is operable to determine when a pulse is present. This information is then relayed to the input of a time latch circuit 140. The time latch circuit 140 receives data from a time counter 142 to latch the data therein. The time counter 142 is initiated when the pulse is generated from the pulse generator 132 and provides continually changing data on a bus 144 between the time counter 142 and the time latch circuit 140. When the pulse is detected, this data is latched into the time latch circuit 140 by the pulse detector 138. The output of the time latch 140 is connected to the data bus 122 and the miscellaneous control circuit 130 is operable to store this data in a predetermined location in the RAM 126.

In operation, the time counter 142 is initiated simultaneous with initiation of the pulse generator 132. The pulse generator 132 generates a spike of around 70 to 80 volts to illicit a power output from the transducer 92 of approximately 5 watts. The time counter 142 begins to count from the time that the pulse is generated and continues to count until a reflected pulse is detected by the pulse detector 138, at which time the time latch circuit 140 latches the count on the output of the time counter 142. This data is stored in the RAM 126, the time counter 142 reset and another pulse generated by the pulse generator 132. This is continued a predetermined number of times over a short interval of time and all of the data stored in the RAM 126. This data is then analyzed by the CPU 116 in accordance with the program stored in the PROM 128 to determine if the data correlates; that is, it is necessary that subsequent time measurements of the transmitted/reflected wave be compared to determine if spurious noise is present. This can be any kind of algorithm which requires, for example, a percent of the responses for a given measurement to be within approximately five percent of each other. The algorithm can be more complicated to alleviate any discrepancies due to spurious noise.

After the measurement has been validated, it is stored in RAM 126 at a predetermined address in associated with time information. This time information can be generated in the time counter 142 or it can be extracted from an internal clock in the CPU 116 (not shown). Another measurement is then taken after a predetermined period of time. It is not necessary to continually take measurements since this amount of data would be overburdensome and require a large amount of memory. This is due to the fact that the measurement is relatively fast as compared to the overall drilling operation. Therefore, between each measurement, the control circuit 86 goes into a "power down" mode to conserve battery power.

After each measurement is taken and stored, this data is stored with the previous data and the rate at which the core length is entering the inner barrel 32 is determined. This rate is compared with a predetermined value to provide an indication as to whether the core is moving into the barrel. If the rate is acceptable, the CPU 116 can then output a "jam" signal, which is stored in the PROM 128 for input to a Universal Asynchronous Receiver Transmitter (UART) 146 for output through an input/output (I/O) buffer 148 to a data acquisition terminal 150. The jam signal can be generated immediately after determining that the rate is below a predetermined level or, alternatively, the measurement can be made again at a later time and the rate reevaluated to determine if the core is in fact jammed. This will primarily be a function of the application since in some applications hard rock may decrease the rate of coring below the predetermined level without actually indicating a jammed condition. This is a function of the program and can be varied depending upon the application.

When the jammed signal is transmitted from the terminal 150, it is connected to the switch 56 to control the valve 50 to relieve the pressure in the drill string. As described above, this indicates to the operator from the surface that the core is no longer moving up into the barrel.

In addition to providing the jam signal, the UART 146 and the I/O buffer 148 are also operable to interface with terminal 150 that allows an external unit to extract data from the RAM 126. This is utilized when the coring device is pulled back to the surface and the SCM 78 removed for analysis. The data provides a profile of time versus distance of the coring process. This can be compared with the drilling speed and other parameters which are normally recorded at the surface.

Figure 7:
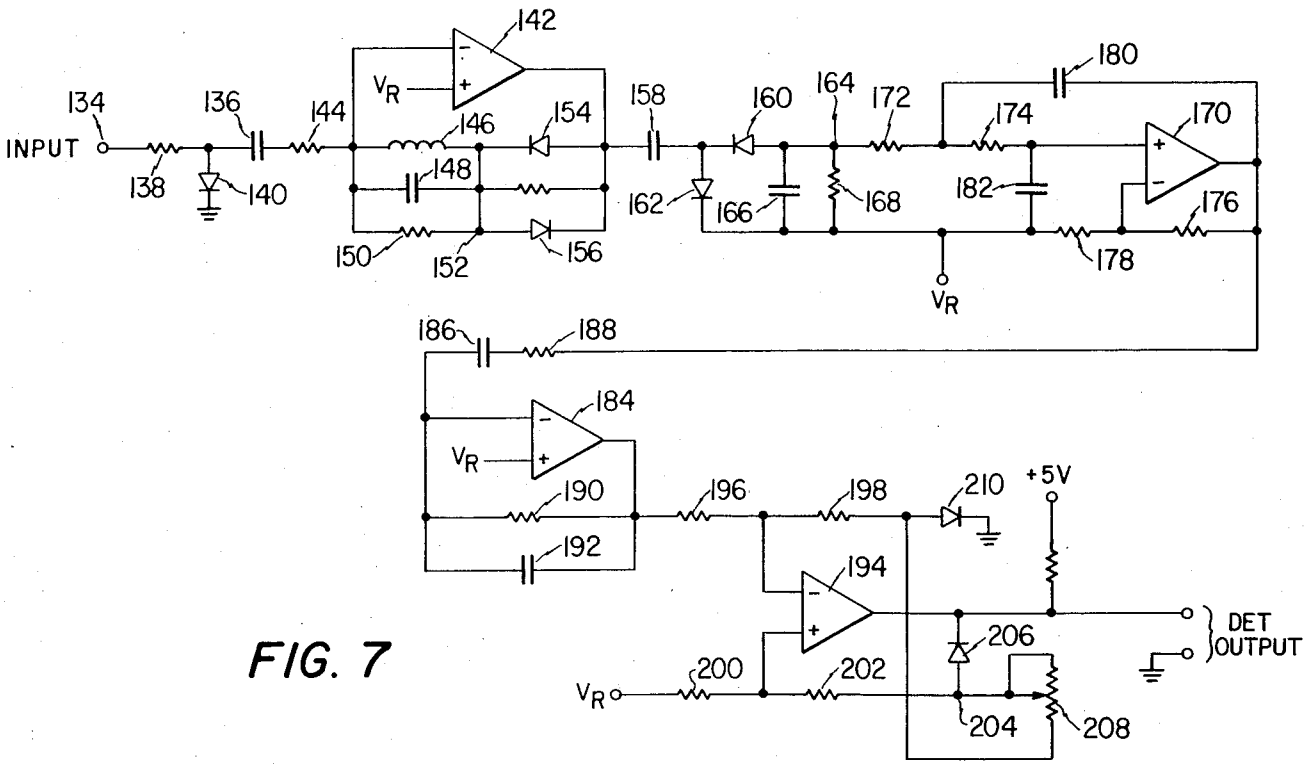
FIG. 7 illustrates a schematic block diagram of the signal processor.

Referring now to FIG. 7, there is illustrated a schematic block diagram of the limiter/amplifier 136. The line 134 from the transducer 92 is input to a capacitor 137 through a series resistor 139. A diode 141 is connected between the junction of the resistor 139 and capacitor 137 and ground with the cathode thereof connected to ground. The resistor 139 and diode 141 provide a limiting function to the input circuit of the limiter/amplifier 136. The other side of the capacitor 137 is connected to the negative input of an op amp 143 through a series resistor 145. The positive input of the op amp 143 is connected to a reference voltage. A feedback network is comprised of a parallel connected inductor 147, capacitor 149 and resistor 151. One side of this parallel configuration is connected to the negative input of the operational amp 143 and the other end thereof connected to a node 152. The node 152 has two parallel diodes 154 and 156 connected thereto and oriented in opposite directions with one end of the parallel pair connected to the node 152 and the other end thereof connected to the output of the op amp 143. The parallel inductor 147, capacitor 149 and resistor 151 perform a bandpass function when used in conjunction with the op amp 143.

The output of the op amp 143 is connected through a capacitor 158 to the cathode of a diode 160. A diode 162 is also connected to the other side of the capacitor 158 and to the reference voltage on the cathode thereof. The anode of the diode 160 is connected to a node 164. The node 164 is also connected to a reference voltage through a parallel capacitor 166 and resistor 168. The diodes 160 and 162 and the diodes 154 and 156 form a detector when used in conjunction with the op amp 143 to detect the pulse.

The node 164 with the detected output therefrom is input to the positive input of an op amp 170 through two series resistors 172 and 174. A capacitor 180 is connected between the conjunction of the resistors 172 and 174 and the output of the op amp 170. A feedback resistor 176 is connected between the negative input of the op amp 170 and the output thereof. The op amp 170 has the negative input connected to the reference voltage through a resistor 178 and the positive input thereof connected to the reference voltage through a capacitor 182. The op amp 170 is configured as a low pass amplifier to provide a low pass filter for the detected output.

The output of the op amp 170 is input to the negative input of an op amp 184 through a series connected capacitor 186 and resistor 188. The positive input of the op amp 184 is connected to the reference voltage and the feedback network comprised of a parallel resistor 190 and capacitor 192 and is connected between the output and negative input of the op amp 184. The op amp 184 is configured as a differentiator.

The output of the op amp 184 is input to the negative input of a comparator 194 through a series resistor 196. The positive input of comparator 194 is connected through a resistor 200 to the reference voltage and through a resistor 202 to a node 204. The node 204 is connected through a diode 206 to the output of the comparator 194 with the anode thereof connected to the resistor 202. The node 204 is connected to one side of a variable resistor 208, the other side of which is connected to the negative input of the comparator 194 through are resistor 198. The other side of the variable resistor is also connected to ground through a diode 210, the cathode of which is connected to ground. The comparator 194 is operable as a threshold detector and trigger with a variable threshold provided by the variable resistor 208. In the preferred embodiment, the supply voltage is approximately 5.0 volts with the reference voltage being approximately 2.5 volts. The resistor 139 and diode 141 provide a limit of approximately 3.5 volts such that a higher voltage will not be impressed across the op amp 143.

Figure 8:
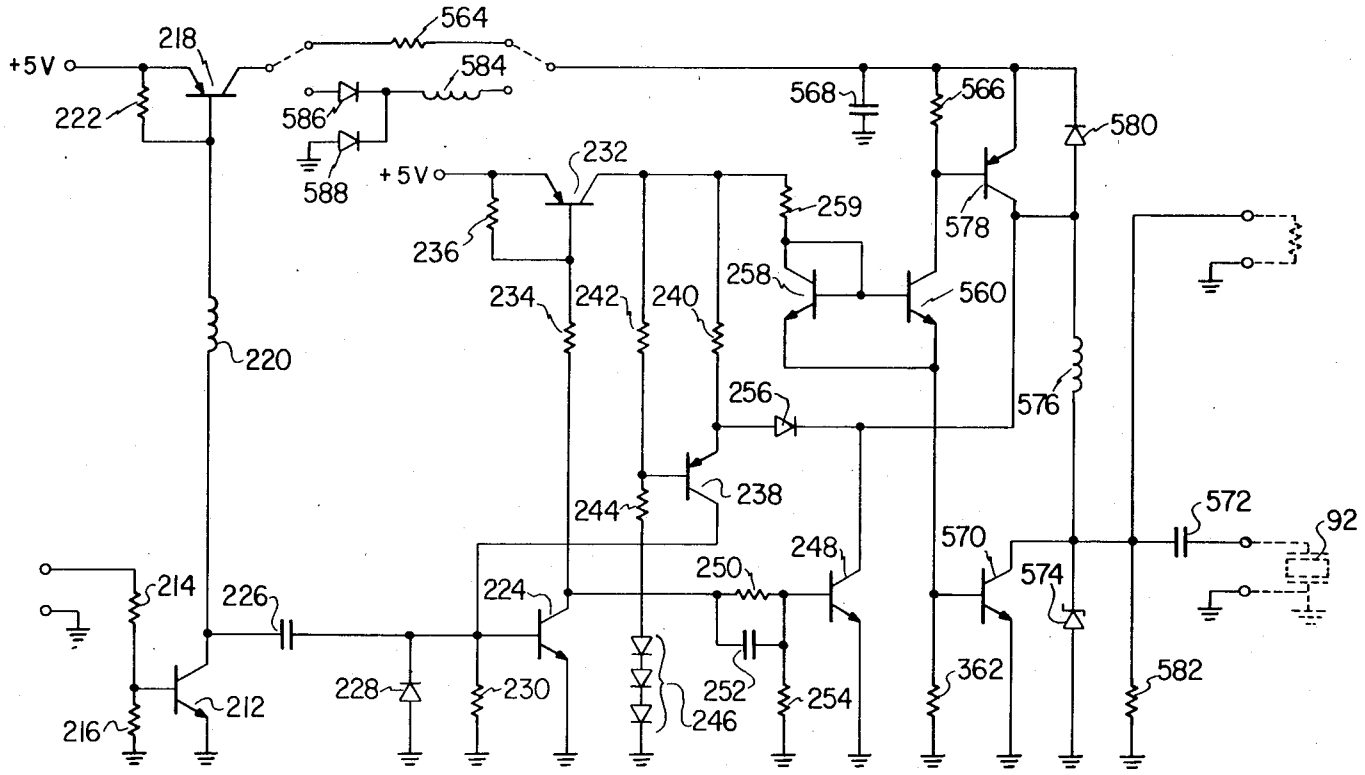
FIG. 8 illustrates a schematic block diagram of the pulse driver for supplying pulses to the transducer.

Referring now to FIG. 8, there is illustrated a schematic diagram of the pulse generator 132. The input signal from the CPU 116 is input to the base of an NPN transistor 212 through a series resistor 214 with a shunt resisotor 216 disposed between the base of the transistor 212 and ground. The transistor 212 has the input thereof connected to ground and the collector thereof connected to the base of a PNP transistor 218 through a resistor 220. The transistor 218 has the emitter thereof connected to the positive voltage supply with a bias resistor 222 connected between the emitter and base thereof to provide bias therefor. The collector of the transistor 212 is connected to the base of a PNP transistor 224 through a series capacitor 226. A diode 228 and resistor 230 are connected in parallel and this parallel configuration shunted across the base of the transistor 224 to ground with the cathode of the diode 228 connected to the base thereof. The transistor 224 has the emitter thereof connected to ground and the collector thereof connected to the base of a PNP transistor 232 through a series resistor 234. The transistor 232 is configured similar to the transistor 218 with a bias resistor 236 connected across the emitter and base thereof.

The capacitor 226 also couples the collector of the transistor 212 to the collector of a PNP transistor 238, the emitter of which is connected to the collector of the transistor 232 through a series resistor 240 and the base of which is connected to the emitter of the transistor 232 through a series resistor 242. The base of the transistor 238 is also connected to ground through a series resistor 244 and three series diodes 246, the cathodes of which are oriented toward ground.

The collector of the transistor 224 is connected to the base of an NPN transistor 248 through a parallel configured resistor 250 and capacitor 252. The transistor 248 also has the base thereof connected to ground through a resistor 254, the emitter thereof connected to ground and the collector thereof connected to the emitter of the transistor 238 through a series diode 256, the anode thereof connected to the emitter of the transistor 238.

The emitter of the transistor 232 is also connected to a current mirror comprised of a transistor 258 and a transistor 260, the emitters of which are connected to ground through a resistor 262. The high current side of the current mirror transistor 260 is connected to the collector of the transistor 218 through a series resistor 264 and a series resistor 266. A capacitor 268 is disposed between the junction between the resistors 264 and 266 and ground. The capacitor 268 has a value of approximately 3.3 microfarads and is operable to store a large amount of charge therein. The output of the current mirror on the emitter of the transistor 260 is input to the base of an NPN transistor 270, the emitter of which is connected to ground and the collector of which is connected to the transducer 92 through a series capacitor 272. A zener diode 274 is disposed between the collector of the transistor 270 and ground with the cathode thereof connected to the collector. The collector of the transistor 270 is driven with a series inductor 276 from the collector of a PNP transistor 278. The collector of the PNP transistor 278 is also connected to the collector of the transistor 248, the transistor 248 shunting the collector to ground. The emitter of the transistor 278 is connected to the positive side of the capacitor 268 with a diode 280 connected between the collector and the emitter thereof. A resistor 282 is connected between the collector of transistor 270 and ground.

In operation, a signal is received on the base of the transistor 212 which causes current to flow through the transistor 218 to charge up capacitor 268 through resistor 264. Transistor 224 is also turned on mementarily by the signal that is ac coupled through the capacitor 226 to cause transistor 232 and transistor 248 to conduct. Transistor 232 supplies current to the control side of the current mirror on collector of transistor 258 which in turn turns on transistor 270 to pull one side of the inductor 276 to ground. Since transistor 248 is also turned on by a transistor 224, the inductor 276 is essentially placed in parallel with the capacitor 268.

The circuit of FIG. 8 allows the capacitor 268 to charge and this charge is then stored in the inductor 276. This requires one-half of the cycle of the resonant frequency of the parallel combination of the capacitor 268 and inductor 276. On the second half of the cycle, the charge on the capacitor 268 decreases, turning off transistor 278 and transistor 270 also turns off, thus allowing the coil to be placed in series with the transducer 92. The charge stored in the inductor 276 is then transferred to the transducer 92 through the capacitor 272, which is a low value capacitor of approximately 2.2 nanofarads. In the preferred embodiment, the capacitor 268 is approximately 3.3 microfarads and the inductor 276 is approximately four microhenries. The voltage supply of the preferred embodiment is approximately 5.0 volts. The pulse applied to the transducer 92 has a voltage level of approximately 70 to 80 volts.

In order to increase the voltage output, an alternate circuit is provided to replace the resistor 264 on the output of the transistor 218. The alternate circuit is comprised of a series inductor 284 and diode 286, the diode having the cathode thereof directed away from the transistor 218. A shunt diode 288 has the cathode thereof connected to the cathode of the diode 286 and the anode thereof connected to ground. The alternate circuit allows for a higher voltage to be placed onto the capacitor 268, thus increasing the voltage output from the inductor 276.

In summary, there has been provided a device for monitoring the core as it enters the inner core barrel. The device is comprised of an ultrasonic transducer and associated control circuitry that is mounted in the upper end of the inner barrel. A piston or similar metallic surface is mounted in the lower end of the inner barrel and is operable to precede the core up through the inner barrel. The ultrasonic transducer is operable to transmit pulses and monitor reflections therefrom. The time difference between the transmitted pulse and received reflected pulse from the top of the piston is measured and this data recorded. Additionally, comparison is made with a predetermined value to ascertain whether the core is reciprocating upward into the barrel at a predetermined rate. If the core is not reciprocating upward, a fault signal is generated to indicate a jam and a valve in the core barrel actuated to bypass drilling fluid from the normal flow. This provides an indication to the surface operator that the core barrel is jammed and must be extracted for repair or replacement thereof.

Although the preferred embodiment has been described in detail, it should be understood that various changes, substitutions and alterations can be made therein without departing from the spirit and scope of the invention as defined by the appended claims.

What is claimed is:

1. A well core drilling apparatus for retrieving a core from a bore hole, comprising:

coring means for boring the well core at the bottom of the bore hole;

container means associated with said coring means for containing the well core;

measurement means disposed in the upper end of said coring means for generating signal directed downwards toward the core and receiving the energy of said signals reflected from the core and calculating the distance of the core from said measurement means;

said measurement means calculating time versus distance for storage internal thereto and comparing said distance versus time measurement with a predetermined value;

means for generating a fault signal when said distance versus time calculation is less than its predetermined value indicating that the core is not progressing up into said container means at a rate defined by said predetermined value; and means for indicating to the surface that said fault signal has been generated.

2. The drilling apparatus of claim 1 and further comprising an absorbent member disposed on the inner walls of said container and positioned adjacent said well core, said absorbant member absorbing energy impinging upon the surface thereof to prevent reflections of energy therefrom.

3. The drilling apparatus of claim 2 wherein said absorbant member also absorbs subterranean fluid that bleeds from said well core to allow recovery of said subterranean fluid proximate the point in the core from which the subterranean fluid bleeds.

4. The drilling apparatus of claim 1 wherein said measurement means comprises:

means for generating an ultrasonic pulse directed downward through said container means toward the core;

means for receiving said ultrasonic pulse;

means for measuring the time between generation of said pulse and reception thereof;

means for storing said distance information; and means for calculating distance versus time.

5. The drilling apparatus of claim 4 wherein said means for transmitting and said means for receiving comprises a piezoelectric transducer.

6. The drilling apparatus of claim 1 and further comprising reflective means for disposal at the lower end of said container means for preceding the core upward into said container means, said reflecting means providing a highly reflective source to said signal.

7. The drilling apparatus of claim 1 wherein said container means comprises a hollow fluid impermeable right circular cylinder.

8. The drilling apparatus of claim 1 wherein said container means is filled with a relatively imcompressible fluid that flows outward from said container means as the core enters said container means such that the medium for transmission of said signal therethrough is relatively constant.

9. A well core drilling apparatus for recovery of a well core from the bottom of a bore hole, comprising:

an outer barrel for rotation in a bore hole;

a drill bit mounted on the end of said outer barrel for drilling the core;

means for rotating said outer barrel;

an inner barrel disposed within said outer barrel and stationary with respect to the rotation of said outer barrel;

measurement means disposed in the upper end of said inner barrel, said measurement means having:

means for generating an ultrasonic signal, means for receiving reflected energy from said generated ultrasonic signal, means for measuring the time interval between generation of said ultrasonic energy and reception of the reflected energy therefrom, means for calculating distance as a function of said measured time interval, means for storing said distance information as a function of time, means for measuring the difference between two succesive distance measurements, and means for comparing said calculated difference with a predetermined value and generating a fault signal when said difference is less than said predetermined value;

reflective means disposed in the lower end of said inner barrel for preceding the core as the core reciprocates upward into said inner barrel;

absorbant means disposed on the inner peripheral sides of said inner barrel for absorbing energy from said measurement means to prevent spurious reflections therefrom; and means for communicating to the surface that said fault signal is generated.

10. The drilling apparatus of claim 9 wherein said absorbant means comprises a hollow cylinder of absorbant material and disposed in said inner barrel about the inner peripheral sides of said inner barrel.

11. The drilling apparatus of claim 9 wherein said absorbant means further is utilized for absorbing subterranean fluids contained in the well core to provide a profile thereof along the longitudinal axis of the well core.

12. The drilling apparatus of claim 9 wherein said absorbant means comprises polyurethane foam.

13. The drilling apparatus of claim 9 wherein said reflective means comprises a piston fabricated from a material highly reflective to said ultrasonic signal generated by said measurement means and disposed in the lower end of said inner barrel.

14. The drilling apparatus of claim 13 and further comprising:

means for sealing the end of said inner barrel when said piston is disposed thereat, said seal broken when said piston moves upward into said inner barrel; and a pressurized fluid disposed in said inner barrel and operable to exit said inner barrel as the core proceeds upward therein, said pressurized fluid providing an essentialy constant transmission medium to said ultrasonic signals.

15. A well core drilling apparatus for recovery of a well core from the bottom of a bore hole, comprising:

an outer barrel for lowering into a bore hole;

a coring drill bit disposed on the end of said outer barrel and rotatable therewith;

means for rotating said outer barrel to form the lower hole;

an inner barrel disposed in said outer barrel for receiving the well core;

a reciprocating piston disposd in the lower end of said inner barrel for preceding the core upward into the inner barrel;

means for sealing the lower end of said inner barrel when said piston is disposed thereat, the seal provided by said sealing means broken when said piston moves away from the lower end of said inner barrel;

measurement apparatus disposed at the upper end of said inner barrel, said measurement apparatus having:

a piezoelectric transducer, means for exciting said piezoelectric transducer to generate a pulse of ultrasonic energy directed downward into the inner barrel toward the surface of said piston, means for detecting reflected energy from said piston, means for measuring the time interval between exitation and detection of said energy and calculating distance therefrom, means for storing said calculated distance, means for measuring the difference between two successive measurements of said calculated distance, and means for comparing said calculated difference with a predetermined value and generating a fault signal if said difference is less than said predetermined value;

a layer of polyurethane foam disposed on the interior surface of said inner barrel to form an absorption layer for said ultrasonic signals to prevent reflection from the sides of said inner barrel;

a pressurized fluid disposed in said inner barrel for providing an essentially constant transmission medium for said ultrasonic signals, said fluid exiting said inner barrel when the core proceeds upward therein and breaks the seal; and means for indicating to the surface that said fault signal is generated.

16. The drilling apparatus of claim 15 wherein said means for indicating generation of said fault signal comprises means for relieving the drilling pressure in said outer barrel, said pressure relieving means providing a sufficient reduction in pressure for measurement at the surface wherein pressure measurement at the surface provides a visual indication of the generation of said fault signal.

17. A method for measuring the rate at which a well core proceeds up into the inner barrel of a well coring device, comprising:

providing an inner barrel;

generating an ultrasonic signal at the upper end of the inner barrel in the well coring device;

detecting the energy that reflects from the core and travels upward to the upper end of the inner barrel;

measuring the time interval between generation of the ultrasonic signal and reception of the reflected energy from the core and calculating distance;

storing said calculated distance;

calculating the difference between two successive distance measurements;

comparing said calculated difference with a predetermined value and generating a fault signal if said calculated difference is less than a predetermined value; and providing an indication to the surface of the generation of said fault signal.

18. The method of claim 17 and further comprising absorbing energy of the generated ultrasonic signal that impinges upon the sides of the inner barrel to reduce reflections therefrom.

* * * * *